US005391310A

United States Patent [19]

Krueger et al.

[11] Patent Number: 5,391,310

[45] Date of Patent: Feb. 21, 1995

[54] SULFURIZED AQUEOUS MACHINING FLUID COMPOSITION

[75] Inventors: Mark K. Krueger, Loveland; Jerry P. Byers, Cincinnati; Henry Turchin, Loveland, all of Ohio

[73] Assignee: Cincinnati Milacron Inc., Cincinnati, Ohio

[21] Appl. No.: 156,323

[22] Filed: Nov. 23, 1993

[51] Int. Cl.[6] ..... C10M 135/02

[52] U.S. Cl. ..... 252/45; 252/47; 252/49.3; 72/42

[58] Field of Search ..... 252/45, 47, 48.6, 49.3, 252/49.5, 32.7 E; 72/42

[56] References Cited

U.S. PATENT DOCUMENTS

| | | | |
|---|---|---|---|
| Re. 31,242 | 5/1983 | Andlid et al. | 252/49.5 |
| 2,343,393 | 3/1944 | Bergen | 252/47 |
| 2,524,017 | 9/1950 | Hance et al. | 252/48.6 |
| 2,897,152 | 7/1959 | Elliott et al. | 252/47.5 |
| 3,027,324 | 3/1962 | Rosenberg | 252/48.6 |
| 3,853,775 | 12/1974 | Williams | 252/42.1 |
| 3,876,550 | 4/1975 | Holubec | 252/47.5 |
| 4,456,540 | 6/1984 | Recchuite | 252/48.6 |
| 4,485,044 | 11/1984 | Kammann et al. | 260/399 |
| 4,609,480 | 9/1986 | Hata et al. | 252/32.7 |
| 4,648,985 | 3/1987 | Thorsell et al. | 252/32.5 |
| 4,773,274 | 11/1988 | Jokinen et al. | 252/32.7 |
| 4,957,651 | 9/1990 | Schwind | 252/56 |
| 4,959,166 | 9/1990 | Minamitani et al. | 252/327 |
| 4,978,465 | 12/1990 | Sturwold | 252/48.4 |
| 5,133,888 | 7/1992 | Waynick | 252/33.4 |

FOREIGN PATENT DOCUMENTS

| | | | |
|---|---|---|---|
| 2044798 | 2/1980 | United Kingdom | C10M 3/32 |

OTHER PUBLICATIONS

European Patent Abstracts; Week 9051; p. 175; Abstract No. EP403-205A.

European Patent Abstracts; Week 9012; p. 100; Abstract No. EP359-145A.

European Patent Abstracts; Week 8847; p. 6; Abstract No. EP291-521A.

European Patent Abstracts; Week 8616; p. 124; Abstract No. EP178-177A.

European Patent Abstracts; Week 8548; p. 36; Abstract No. EP162-261A.

European Patent Abstracts; Week 8540; p. 116; Abstract No. EP156-572A.

Derwent Patent Abstracts; Week E-44; p. 2, 1982; Abstract No. EP63-327.

Derwent Patent Abstracts; Week C-16; p. 103, 1980; Abstract No. EP9-701.

Japan Patent Abstracts, vol. 17, No. 211, Dec. 8, 1992; Abstract No. 04-353599, Appln. No. 03-128933.

Japan Patent Abstracts, vol. 17, No. 171, Nov. 17, 1992; Abstract No. 04-328198, Appln. No. 03-124524.

Japan Patent Abstracts, vol. 17, No. 124, Oct. 27, 1992; Abstract No. 04-304300, Appln. No. 03-94748.

Japan Patent Abstracts, vol. 16, NO. 490, Jun. 25, 1992; Abstract No. 04-178499, Appln. No. 02-303964.

Japan Patent Abstracts, vol. 16, No. 394, May 1, 1992; Abstract No. 04-130193, Appln. No. 02-415155.

(List continued on next page.)

*Primary Examiner*—Prince Willis, Jr.

*Assistant Examiner*—Cephia D. Toomer

*Attorney, Agent, or Firm*—John W. Gregg; Donald Dunn

[57] ABSTRACT

Aqueous machining fluid compositions, especially aqueous metalworking fluid compositions, are provided that exhibit improved reduction of friction and forces in the mechanical shaping and working of metallic and solid non-metallic workpieces. These compositions comprise a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of a dialkyldithiocarbamic acid.

27 Claims, No Drawings

OTHER PUBLICATIONS

Japan Patent Abstracts, vol. 16, No. 238, Feb. 19, 1992; Abstract No. 04-50296, Appln. No. 02-158916.

Japan Patent Abstracts, vol. 16, No. 81, Nov. 29, 1991; Abstract No. 03-269093, Appln. No. 02-172046.

Japan Patent Abstracts, vol. 15, No. 293, May 7, 1991; Abstract No. 03-106995; Appln. No. 01-243923.

Japan Patent Abstracts, vol. 13, No. 549, Sep. 8, 1989; Abstract No. 01-255696; Appln. No. 63-50609.

Japan Patent Abstracts, vol. 13, No. 21, Sep. 16, 1988; Abstract No. 63-223092, Appln. No. 62-55311.

Japan Patent Abstracts, vol. 12, No. 283, Mar. 17, 1988; Abstract No. 63-61091, Appln. No. 61-205349.

Japan Patent Abstracts, vol. 6, No. 158, May 12, 1982; Abstract No. 57-76096; Appln. No. 55-152271.

SULFURIZED AQUEOUS MACHINING FLUID COMPOSITION

FIELD OF THE INVENTION

This invention pertains to aqueous machining fluid compositions employed in the shaping and working of metal and solid non-metal workpieces and such processes using machining fluid compositions. Further this invention pertains to aqueous machining fluids having sulfur containing components to achieve improved machining performance.

BACKGROUND OF THE INVENTION

Oil (i.e. non-aqueous) based fluids have long been known in the art for use in metalworking process (i.e. processes for mechanically shaping and working metals). Such fluids have exhibited good lubricating and cooling functions which reduce friction and dissipate heat in a metalworking process, This reduction of friction and dissipation of heat promotes long tool life, increases production and allows the attainment of high quality finished metal products. Many of the oil based metalworking fluids contain sulfurized oils to achieve effective friction reduction in the metalworking process. These sulfurized oils often have a high sulfur content and cause odor problems in metalworking operations, especially when sufficient heat is generated in the metalworking process. Notwithstanding the effectiveness of many oil based metalworking fluids such fluids exhibit, in addition to odor problems, disposal problems, health problems from vapors, safety problems, material availability problems and costs which have lead to the increased demand for and use of aqueous based metalworking fluids. Aqueous based metalworking fluids have been found to have fewer disposal, health, safety and availability problems than oil based metalworking fluids. Aqueous based metalworking fluids have low fire hazard, often easier disposal and many times lower cost characteristics compared to oil based metalworking fluids. In spite of these advantages aqueous based metalworking fluids have often exhibited lower performance (e.g. lower friction reduction) than oil based metalworking fluids. This lower performance has resulted often in a reduction in productivity and tool life. In metal grinding operations such lower performance is shown in greater wheel wear, lower G-ratios, increased frequency of wheel dressing, lower output and poorer finish on the parts.

Metalworking operations mechanically shape and work metallic workpieces by cutting and non-cutting processes. The cutting processes include, for example, drilling, grinding, milling, tapping, turning and broaching. Non-cutting processes include, for example, rolling, drawing, extrusion, drawing and ironing, punching, stamping and spinning processes.

There has been and continues to be the need for improving the performance of aqueous based metalworking fluids. In view of the safety, environmental and economic advantages of aqueous based metalworking fluids the art has thus continuously sought the improvement of the performance of such fluids.

It is therefore an object of this invention to provide an aqueous machining fluid composition for improving mechanical shaping and working processes on metallic and solid non-metallic workpieces. Another object of this invention is to provide an aqueous machining fluid composition overcoming disadvantages of prior art aqueous metalworking fluids. A still further object of this invention is to provide an aqueous machining fluid composition which avoids disadvantages of prior art non-aqueous oil based metalworking fluids.

SUMMARY OF THE INVENTION

These and other objects as will be apparent to those skilled in the art from the following description and claims are provided by the aqueous machining fluid composition of this invention. There is now provided in accordance with this invention an aqueous machining fluid composition comprising water, a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, a sulfurized hydrocarbon and an aliphatic ester of dialkyldithiocarbamic acid. In the context of this description and the appended claims and as used herein the phrase machining fluid composition shall mean a workpiece contacting fluid composition employed in and for the mechanical shaping and working of metallic and solid non-metallic workpieces or objects. The term workpiece, as used in this description and the appended claims shall mean that solid object which is being subject to a mechanical shaping or working process. Non-metallic workpieces shall include, but not be limited to, glass, ceramic and plastic workpieces. Metallic workpieces may include, for example, steel, stainless steel, rolled steel, iron, cast iron, aluminum, copper, brass, titanium and various metal alloy workpieces or objects.

DESCRIPTION OF THE INVENTION

It has now been discovered that the forces encountered in the shaping and working (i.e. machining) of metallic and solid non-metallic workpieces or objects (e.g. metal cutting operations) can be reduced, tool life increased and productivity increased and that many of the draw backs of prior art aqueous machining fluid compositions, more particularly aqueous metalworking fluid compositions, can be overcome by the friction reducing effective aqueous machining fluid compositions provided by this invention which comprise a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having from 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid. Additionally, in accordance with this invention there are provided aqueous machining fluid compositions comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid having the following formula

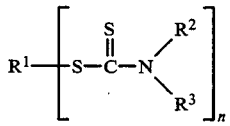

where $R^1$ is an aliphatic group having 1 to 20 carbon atoms and a valence equal to n and $R^2$ and $R^3$ are individually alkyl groups having from 1 to 20 carbon atoms and n is 1 or 2. There are additionally provided in accordance with this invention aqueous machining fluid compositions comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and esters and salts thereof, and mixtures thereof, c) a sulfurized hydrocarbon and d) an aliphatic ester of dialkyldithiocarbamic acid having the formula

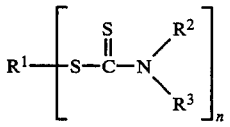

where $R^1$, $R^2$, and $R^3$ are as defined above and n is 1. Further in accordance with this invention there are provided aqueous machining fluid compositions comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid having the formula

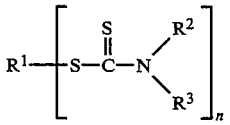

where $R^1$, $R^2$, and $R^3$ are as defined above and n is 2. Still further there are provided in accordance with this invention aqueous machining fluid compositions comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid having the formula

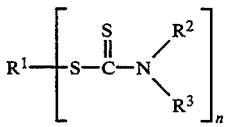

where $R^1$ is an aliphatic group having from 1 to 8 carbon atoms and a valence equal to n, $R^2$ and $R^3$ are individually alkyl groups having from 1 to 20 carbon atoms and n is 1 or 2. Aqueous machining fluid compositions comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid having the formula

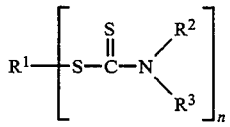

where $R^1$ is an aliphatic group having from 1 to 20 carbon atoms and a valence equal to n, $R^2$ and $R^3$ are individually alkyl groups having 1 to 8 carbon atoms and n is 1 or 2 are also provided in accordance with this invention. The aqueous machining fluid compositions in accordance with this invention may comprise a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, c) a sulfurized hydrocarbon and d) an aliphatic ester of dialkyldithiocarbamic acid having the formula

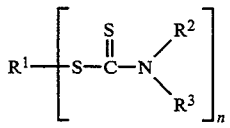

where $R^1$ is an aliphatic group having from 1 to 20 carbon atoms and a valence equal to n, $R^2$ and $R^3$ are individually alkyl groups having 1 to 8 carbon atoms and n is 1.

Preferably the $R^1$, $R^2$ and $R^3$ are hydrocarbon groups. When n in the above formula is 2 the aliphatic ester of the dialkyldithiocarbamic acid is an alkylene bis(dialkyldithiocarbamate). The alkylene bis(dialkyldithiocarbamate) having 1 to 8 carbon atoms in the alkylene group and 1 to 20, preferably 1 to 10, carbon atoms in the alkyl group is the preferred aliphatic ester of the dialkyldithiocarbamic acid. When the aliphatic ester of dialkyldithiocarbamic acid is a mono ester, e.g. an alkyl ester of dialkyldithiocarbamic acid, $R^1$ may be a monovalent aliphatic group (e.g. alkyl) having from 1 to 20, preferably 1 to 10, carbon atoms and $R^2$ and $R^3$ are individually alkyl groups having from 1 to 20, preferably 1 to 10, carbon atoms. In another practice of this invention there is provided an aqueous machining fluid composition, more especially an aqueous metalworking fluid composition, comprising a) water, b) a sulfurized unsaturated aliphatic carboxylic acid having from 6 to 22 carbon atoms or salt thereof, c) a sulfurized hydrocarbon and d) an aliphatic ester of dialkyldithiocarbamic acid having the formula

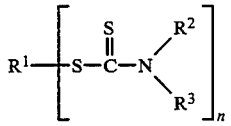

where $R^1$ is an aliphatic group having 1 to 20 carbon atoms, preferably 1 to 10 carbon atoms, and a valence equal to n, $R^2$ and $R^3$ are individually alkyl groups having 1 to 20 carbon atoms, preferably 1 to 10 carbon atoms, and n is 1 or 2. The practice of this invention may also provide an aqueous machining fluid composition, preferably an aqueous metalworking fluid composition, comprising a) water, b) a sulfurized unsaturated ester of an aliphatic carboxylic acid having from 1 to 22 carbon atoms, c) a sulfurized hydrocarbon and d) an aliphatic ester of dialkyldithiocarbamic acid having the formula

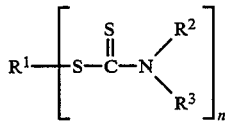

where $R^1$ is an aliphatic group having 1 to 20 carbon atoms, preferably 1 to 10 carbon atoms, and a valence equal to n, $R^2$ and $R^3$ are individually alkyl groups having 1 to 20 carbon atoms, preferably 1 to 10 carbon atoms, and n is 1 or 2. There also may be provided in accordance with the practice of this invention an aqueous machining fluid composition, preferably an aqueous metal working fluid composition, comprising a) water, b) a sulfurized dimerized unsaturated fatty acid or salt or ester thereof, c) a sulfurized hydrocarbon and d) an aliphatic ester of dialkyldithiocarbamic acid having the formula

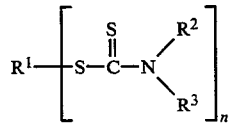

where $R^1$ is an aliphatic group having 1 to 20 carbon atoms, preferably 1 to 10 carbon atoms, and a valence equal to n, $R^2$ and $R^3$ are individually alkyl groups having 1 to 20 carbon atoms, preferably 1 to 10 carbon atoms, and n is 1 or 2. A mixture of a sulfurized unsaturated aliphatic carboxylic acid having from 6 to 22 carbon atoms or salts thereof, a sulfurized unsaturated ester of an aliphatic carboxylic acid having from 1 to 22 carbon atoms and a sulfurized dimerized unsaturated fatty acid or salt or ester thereof may be used as the sulfurized organic material in the practice of the compositions of this invention. Aqueous machining fluid compositions in accordance with this invention may contain petroleum hydrocarbon oil. It is desired in the practice of the aqueous machining fluid composition of this invention that the chosen a) sulfurized organic material be selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, b) sulfurized hydrocarbon and c) aliphatic ester of dialkyldithiocarbamic acid be water soluble or dispersible.

Sulfurized unsaturated aliphatic carboxylic acids having from 6 to 22 carbon atoms usable in the practice of this invention may be prepared from aliphatic monocarboxylic and di-carboxylic acids having from 1 to 3 ethylenically unsaturated groups by methods well known in the art and thus include the sulfurized aliphatic monocarboxylic acids and dicarboxylic acids products which may have none or some of the ethylenically unsaturated groups originally present in the carboxylic acid. Prior art methods for sulfurizing unsaturated aliphatic carboxylic acids include methods for reacting such acids with sulfur, hydrogen sulfide, sodium sulfide, sulfur halide, sulfur dioxide or like sulfurizing agents, often at elevated temperatures and optionally in the presence of an inert solvent. Examples of the sulfurized unsaturated aliphatic carboxylic acids having from 6 to 22 carbon atoms usable in this invention include, but are not limited, to the sulfurized products resulting from the sulfurization of sorbic, oleic, linoleic, linolenic, eleostearic, licanic, ricinoleic, palmitoleic, petroselenic, vaccenic, erucic and stearolic acids. Mixtures of sulfurized unsaturated aliphatic carboxylic acids having from 6 to 22 carbon atoms may be used as the sulfurized organic material in the practice of this invention. The salts (e.g. ammonium, amine, alkali metal, alkaline earth metal and copper salts) of the sulfurized unsaturated aliphatic carboxylic acids having from 6 to 22 carbon atoms may be used in the practice of this invention, examples of which include, but are not limited to, ammonium, sodium, potassium, calcium, barium and copper salts of sulfurized oleic, linoleic, sorbic and ricinoleic acids.

Sulfurized unsaturated esters of aliphatic carboxylic acids having from 1 to 22 carbon atoms usable as the sulfurized organic material in accordance with the practice of this invention include the full and partial esters of mono, di and tri hydric alcohols (e.g. ethanol, ethylene glycol and glycerol). The mono, di and tri hydric alcohols from which the esters may be prepared include straight and branched chain saturated and unsaturated aliphatic alcohols, diols and triols and polyoxyalkylene homopolymer and copolymer alcohols (i.e. monohydric alcohol) and diols (i.e. dihydric alcohol) as the alcohol moiety and saturated and unsaturated carboxylic acids as the acid moiety, the requirement being that the resulting ester that is sulfurized contains unsaturation. These esters may occur naturally or may be prepared synthetically by esterification methods well known in the art [e.g. base catalyzed esterification reaction between an alcohol (e.g. ethanol) and an unsaturated aliphatic carboxylic acid (e.g. oleic acid)]. The ester may then be sulfurized by reaction with sulfurizing agents like sulfur, hydrogen sulfide, sulfur dioxide, sulfur halide and sodium sulfide by methods well known in the art and previously described herein. Examples of sulfurized unsaturated esters of aliphatic carboxylic acids having 1 to 22 carbon atoms include, but are not limited to, sulfurized methyl oleate, sulfurized hexyl sorbate, sulfurized dodecyllinolenate, and sulfurized ethylene dilinoleate, 1,6 hexylene diricinoleate, glycerine tripalmitoleate, polyoxyethylene dioleate, polyoxypropylene disorbate and glycerine dilinoleate. The sulfurized ester of an unsaturated aliphatic carboxylic acid having from 6 to 22 carbon atoms employed in the aqueous machining fluid compositions in accordance with this invention may be a sulfurized fat or a sulfurized fatty oil and the fat or fatty oil which has been sulfurized may be of animal or vegetable origin. Examples of such sulfurized fatty materials usable in the practice of this invention include, but are not limited to, sulfurized tallow, sulfurized whale oil, sulfurized palm oil, sulfurized coconut oil, sulfurized rapeseed oil, sulfurized lard oil and sulfurized castor oil. Sulfurized fatty acid esters of polyhydric alcohols, naturally occurring or synthetically prepared, may be used as the sulfurized organic material in the practice of this invention. Such sulfurized fatty acid esters of polyhydric alcohols may include sulfurized fatty acid esters of alkylene diols, polyoxyalkylene diols and alkylene triols. Additional examples of unsaturated esters that may be sulfurized to produce the sulfurized organic material useful in the practice of this invention include, but are not limited to, allyl stearate, allyl linoleate, oleyl butyrate, oleyl hexanoate, and butene dioleate. The sulfurized fat or fatty oil employed in the practice of this invention may have a sulfur content ranging from 2% to 45% by weight. Preferably the sulfur content should be in the range of from 10% to 20% by weight. Sulfurizing fats and sulfurized fatty oils may be prepared by processes well known in the art, for example reacting a suitable sulfurizing agent such as sulfur, hydrogen sulfide, sulfur halide, sodium sulfide or sulfur dioxide with the fat or fatty oil, often at elevated temperatures (e.g. 50° to 350° C.) in the presence or absence of an inert solvent. Sulfurized full and partial fatty acid esters of glycerol or dialcohols (e.g. glycols) may be employed as the sulfurized organic material in the practice of this invention. The sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof may be employed in an amount ranging from 0.01% to 30% by weight, preferably 0.5% to 20% by weight, in the aqueous machining fluid composition of this invention.

The sulfurized polymerized unsaturated fatty acids and salts and esters thereof usable as the sulfurized organic material in accordance with this invention are generally sulfurized polymerized unsaturated fatty acids that are prepared from polymerized unsaturated fatty acids obtained by polymerizing ethylenically unsaturated fatty acids having from 12 to 36 carbon atoms. Generally the polymerized unsaturated fatty acid contains from 2 to 4 monomeric units, 2 to 4 carboxylic acid groups and residual ethylenic unsaturation. The polymerization of ethylenically unsaturated fatty acids is known in the art and such acids and the methods for polymerization have been described in U.S. Pat. No. 3,256,304. Such polymerization of ethylenically unsaturated fatty acids into dimer, trimer and tetramer acids is known in the art and is generally believed, in the art, to result in a cycloaliphatic ring structure. Thus, for example, the dimer acid derived from linoleic acid has been reported, in the art, to have the following structure that can exist in the cis and trans forms.

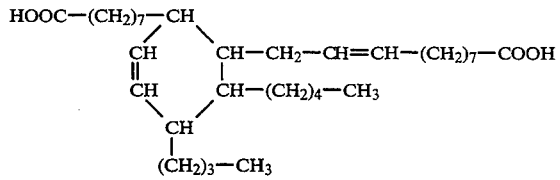

Dimer, trimer and tetramer acids prepared from ethylenically unsaturated fatty acids are commercially available. For example, the dimer of linoleic acid is commercially available as EMPOL 1022 from Emery Industries (EMPOL is a registered trademark of Emery Industries). This dimer acid may contain 2 to 5% of unpolymerized linoleic acid and from 19 to 22% trimer acid. The polymerized ethylenically unsaturated fatty acid may contain a mixture of ethylenically unsaturated fatty acid, dimer acid, trimer acid and tetramer acid in varying proportions depending upon the starting ethylenically unsaturated fatty acid and the conditions under which the polymerization was carried out. Sulfurization of the polymerized unsaturated fatty acid may be achieved by methods well known in the art as previously described herein with respect to unsaturated aliphatic carboxylic acids having from 6 to 22 carbon atoms and the esters thereof. The salts of the sulfurized polymerized unsaturated fatty acid may include, but are not limited to, ammonium, amine, alkali metal, alkaline earth metal and copper, iron, aluminum and like metal salts. Esters of polymerized unsaturated acids that may be sulfurized to produce the sulfurized organic material useable in the practice of this invention include, but are not limited to, mono methyl ester of dimerized linoleic acid, dimethyl ester of dimerized linoleic acid, mono polyoxyalkylene (e.g. polyoxyethylene) glycol ester of dimerized linoleic acid, acid terminated polyoxyalkylene (e.g. ployoxyethylene) glycol diester of dimerized linoleic acid, alcohol terminated polyoxyalkylene (e.g. polyoxyethylene) glycol diester of dimerized linoleic acid, acid terminated polyoxyalkylene (e.g. polyoxypropylene) glycol polyester of dimerized linoleic acid, and alochol terminated polyoxyalkylene (e.g. polyoxypropylene oxyethylene) glycol polyester of dimerized linoleic acid. Examples of sulfurized polymerized unsaturated fatty acids include, but are not limited to sulfurized polymerized oleic acid, sulfurized polymerized linoleic acid, sulfurized polymerized lauroleic acid, sulfurized polymerized vaccenic acid, sulfurized polymerized eleostearic acid and sulfurized polymerized linolenic acid.

Examples of sulfurized hydrocarbons usable in the practice of this invention include, but are not limited to, sulfurized olefin, olefin sulfides, aliphatic hydrocarbon sulfides (e.g. $R^5$—S—$R^6$ where $R^5$ is alkyl of 1 to 20 carbons and $R^6$ is alkyl of 3 to 20 carbons) and sulfurized polyolefin, particularly sulfurized low molecular weight polyolefins. Desirably the sulfurized hydrocarbon should have a sulfur content of from 5% to 45% by weight preferably 32% to 42% by weight. The sulfurized hydrocarbon may be prepared by methods well known in the chemical art. In one such method an olefin may be reacted with sulfurizing agent such as sulfur, hydrogen sulfur dioxide at temperatures ranging from 100° to 350° C. in the presence or absence of an inert solvent medium and often in the presence of an inert atmosphere. There may be employed an amount of sulfurized hydrocarbon ranging from 0.01% to 50% by weight in the aqueous machining fluid composition in accordance with this invention. Preferably the amount of sulfurized hydrocarbon in the aqueous machining fluid of this invention ranges from 1.0% to 30% by weight.

Various esters of dialkydithiocarbamic acid, HS—C(=S)—N—($R^2$)($R^3$) where $R^2$ and $R^3$ are as previously defined herein, may be used in the practice of this invention. Alkylene bis (dialkyldithiocarbamate) is a preferred ester, examples of which include, but are not limited to, methylene bis (dibutyldithiocarbamate), ethylene bis (dipropyldithiocarbamate), ethylene bis (dibutyldithiocarbamate, ethylene (tetramethylene dithiocarbamate) (dibutyldithiocarbamate), propylene bis (diethyldithiocarbamate), hexylene bis (dipropyldithiocarbamate), 1,4-butylene bis (decyldithiocarbamate), 1,8-octylene bis (diisopropyldithiocarbamate) and methylene bis (tetramethylenedithiocarbamate). There may be used alkylene bis (dialkyldithiocarbamate) whose alkylene group has from 1 to 20 carbon atoms. Alkyl esters of dialkyldithiocarbamic acid which have the general formula $R^1$—S—C(=S)—N($R^2$)($R^3$), wherein $R^1$, $R^2$ and $R^3$ are as previously defined herein, may be used in the practice of this invention. Examples of such alkyl esters include, but are not limited to, methyl dibutyldithiocarbamate, ethyl dipropyldithiocarbamate, decyl dibutyldithiocarbamate, hexyl didecyldithiocarbamate, octadecyl diisopropyldithiocarbamate, octyl methylpropyldithiocarbamate and isobutyl propyldecyldithiocarbamate. A wide range of concentrations of the ester of dialkyldithiocarbamic acid may be employed in the aqueous machining fluid composition of this invention. Thus the ester of dialkyldithiocarbamic acid may be used in a concentration ranging from 0.01% to 30% by weight, preferably 0.5% to 20% by weight, based on the total aqueous machining fluid of this invention.

It has been discovered that the combination of a) sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, b) sulfurized hydrocarbon and c) aliphatic ester of dialkyldithiocarbamic acid in an aqueous machining fluid composition (e.g. aqueous metalworking fluid) provides superior performance, improved friction reduction and lower forces during the machining (e.g. metal cutting) operation than comparable aqueous machining (e.g. metalworking) fluid compositions containing the sulfurized organic material, sulfurized hydrocarbon or aliphatic ester of dithiocarbamic acid individually or in-pair combinations (i.e. combinations of any 2 of the 3 materials). Various combinations of a) sulfurized organic material selected from the group consisting of sulfurized unsaturated aliphatic carboxylic acids having from 6 to 22 carbon atoms, sulfurized polymerized unsaturated fatty acids and salts and esters thereof, and mixtures thereof, b) sulfurized hydrocarbon and c) aliphatic ester of dialkyldithiocarbamic acid may be employed in the aqueous machining fluid compositions according to this invention. One such combination can be sulfurized lard oil, olefin sulfide and methylene bis (dibutyldithiocarbamate). Other combinations include, but are not limited to a) sulfurized whale oil, sulfurized olefin and ethylene bis (dibutyldithiocarbamate), b) sulfurized palm oil, olefin sulfide and methylene bis (dibutyldithiocarbamate), c) sulfurized coconut oil, diisobutyl disulfide and ethylene bis (dipropyldithiocarbamate), d) sulfurized rapeseed oil, dioctyl polysulfide and 1,4-butylene bis (decyldithiocarbamate), e) sulfurized lard oil, olefin sulfide and propyl (dibutyldithiocarbamate), f) sulfurized palm oil, dioctadecyl sulfide and decyl (dipropyldithiocarbamate), g) sulfurized tallow, octadecyl sulfide and ethylene (tetramethylene dithiocarbamate) (dibutyldithiocarbamate), h) sulfurized lard oil, olefin sulfide and 1,8-octylene bis (diisopropyldithiocarbamate), i) sulfurized lard oil, diisobutyl disulfide and methylene bis (tetramethylene dithiocarbamate), j) sulfurized palm oil, propyl decyl sulfide and 1,12-dodecyl bis (diethyldithiocarbamate), k) sulfurized whale oil, sulfurized polyolefin and ethylidene bis (dibutyldithiocarbamate), 1) sulfurized oleic acid, sulfurized olefin and methylene bis (dibutyldithiocarbamate), m) sulfurized linoleic acid, olefin sulfide and ethylene bis (dibutyldithiocarbamate), n) sulfurized sorbic acid, octadecyl sulfide and propyl dibutyldithiocarbamate, o) sulfurized licanic acid, dioctyl polysulfide and methylene bis (tetramethylene dithiocarbamate), p) sulfurized erucic acid, diisobutyl disulfide and 1,4 butylene bis (decyldithiocarbamate), q) sulfurized ethyl oleate, sulfurized olefin and methylene bis (dibutydithiocarbamate), r) sulfurized propyl sorbate, olefin sulfide and ethylene bis (dibutyldithiocarbamate), s) sulfurized octyl linoleate, diisobutyl disulfide and propyl dibutyldithiocarbamate, t) sulfurized decyl eleostearate, octadecyl sulfide and decyl (dipropyldithiocarbamate), u) sulfurized decyl eleostearate, octadecyl sulfide and decyl (dipropyldithiocarbamate), v) sulfurized ethylene dioleate, sulfurized olefin and methylene bis (dibutyldithiocarbamate), w) sulfurized hexylene dilinoleate, olefin sulfide and ethylene bis (dibutyldithiocarbamate), x) sulfurized polyoxyethylene dioleate, sulfurized olefin, octyl diisopropyldithiocarbamate and y) sulfurized polyoxypropylene dilinoleate, octadecyl sulfide and 1,4 butylene bis (diisopropyldithiocarbamate).

The aqueous machining fluid compositions of this invention may be prepared by conventional methods well known in the art. Thus the sulfurized organic material selected from the group consisting of sulfurized unsaturated aliphatic carboxylic acids having from 6 to 22 carbon atoms and salts thereof, sulfurized unsaturated esters of aliphatic carboxylic acids having 1 to 22 carbon atoms, sulfurized polymerized unsaturated fatty acids and salts and esters thereof, and mixtures thereof, the sulfurized hydrocarbon and the aliphatic ester of dialkyldithiocarbamic acid may be added in various orders in preparing the aqueous machining composition according to this invention. When employing a water dispersable sulfurized organic material, sulfurized hydrocarbon or aliphatic ester of dialkyldithiocarbamic acid there may be used a surfactant or emulsifying agent to disperse any or all of these components. Thus when a surfactant, emulsifier or other dispersing agent is employed it may be added to the aqueous medium prior to adding any or all of the sulfurized organic material, sulfurized hydrocarbon or aliphatic ester of dialkyldithiocarbamic acid. Alternatively it may be possible to combine the surfactant, emulsifier or other dispersing agent with the sulfurized organic material, sulfurized hydrocarbon or aliphatic ester of dialkyldithiocarbamic acid before adding any or all of these components to the aqueous medium. It will be readily understood by those skilled in the art that various procedures may be employed in preparing the compositions according to this invention and thus it is intended that the aqueous machining fluid composition of this invention shall not be limited by the manner of its preparation.

There may be added to the aqueous machining fluid composition of this invention, in conventional amounts, well known in the art, various additives such as for example corrosion inhibitors, biocides, fungicides, bacteriocides, surfactants, antioxidants, antifoamers and metal particle precipitating agents well known in the art.

It is common practice in the art to prepare and ship aqueous based machining fluid compositions (e.g. aqueous metalworking fluid compositions) in a concentrated form. Such concentrated form is then diluted with water to a use concentration by the end user (i.e. the user of the fluid) and the diluted fluid employed in the machining operation. The concentrated form of the fluid usually contains a small amount of water, typically less than 10%. However larger amounts of water may be in the fluid composition prepared and shipped, which may then be diluted further with water to produce an end use concentration for the fluid. The advantage to preparing and shipping the concentrated form of the aqueous machining fluid is that it avoids sending large quantities of water from the producer of the fluid to the user of the fluid since the user can economically add water to the fluid to obtain the desired use concentration. Thus preparing and shipping the concentrated form of the aqueous machining fluid composition provides an economic advantage over preparing and shipping the fluid in an end use concentration. In the context of this description and the appended claims it is intended and shall be understood that the aqueous machining fluid composition in accordance with this invention shall include the concentrated form, the diluted form for end use and all concentrations there between.

The aqueous machining fluid compositions of this invention may be employed in the mechanical shaping and working of metallic (e.g. steel) workpieces by cutting and non-cutting methods and may also be employed in the mechanical shaping and working of solid non-metallic workpieces such as for example the mechanical cutting operations such as sawing, turning, drilling and grinding of glass and ceramic workpieces as well as the shaping of plastic workpieces by mechanical cutting operations such as sawing and drilling.

This invention will now be further described in the following non-limiting examples in which quantities of components are percentages by weight unless otherwise indicated

| | |
|---|---|
| Triethanolamine | 18.00 |
| Emulsifier (1) | 10.00 |
| Neodecanoic acid | 0.40 |
| Water | 71.60 |

| | |
|---|---|
| Disodium-2,5-dimercapto-1,3,4-thiadiazole (2) | 6.10 |
| Water | 93.90 |

| | |
|---|---|
| Sulfurized lard oil (14–16% sulfur) | 6.80 |

-continued

| | |
|---|---|
| Triethanolamine | 18.00 |
| Emulsifier (1) | 10.00 |
| Neodecanoic acid | 0.40 |
| Water | 64.80 |

| | |
|---|---|
| Olefin sulfide (36–39% sulfur) | 2.60 |
| Triethanolamine | 18.00 |
| Emulsifier (1) | 10.00 |
| Neodecanoic acid | 0.40 |
| Water | 69.00 |

| | |
|---|---|
| Methylene bis (dibutyldithiocarbamate) | 3.30 |
| Triethanolamine | 18.00 |
| Emulsifier (1) | 10.00 |
| Neodecanoic acid | 0.40 |
| Water | 68.30 |

| | |
|---|---|
| Disodium-2,5-dimercapto-1,3,4-thiadiazole (2) | 3.05 |
| Sulfurized lard oil (14–16% sulfur) | 3.40 |
| Triethanolamine | 9.00 |
| Emulsifier (1) | 5.00 |
| Neodecanoic acid | 0.20 |
| Water | 79.35 |

| | |
|---|---|
| Disodium-2,5dimercapto-1,3,4-thiadiazole (2) | 3.05 |
| Olefin sulfide (36–39% sulfur) | 1.30 |
| Triethanolamine | 9.00 |
| Emulsifier (1) | 5.00 |
| Neodecanoic acid | 0.20 |
| Water | 81.45 |

| | |
|---|---|
| Disodium-2,5-dimercapto-1,3,4-thiadiazole (2) | 3.05 |
| Methylene bis (dibutyldithiocarbamate) | 1.65 |
| Triethanolamine | 9.00 |
| Emulsifier (1) | 5.00 |
| Neodecanoic acid | 0.20 |
| Water | 81.10 |

| | |
|---|---|
| Sulfurized lard oil (14–16% sulfur) | 3.40 |
| Olefin sulfide (36–39% sulfur) | 1.30 |
| Triethanolamine | 18.00 |
| Emulsifier (1) | 10.00 |
| Nedecanoic acid | 0.40 |
| Water | 66.9 |

| | |
|---|---|
| Sulfurized lard oil (14–16% sulfur) | 3.40 |
| Methylene bis (dibutyldithiocarbamate) | 1.65 |
| Triethanolamine | 18.00 |
| Emulsifier (1) | 10.00 |
| Neodecanoic acid | 0.40 |

-continued

| | |
|---|---|
| Water | 66.55 |

| | |
|---|---|
| Olefin sulfide (36–39% sulfur) | 1.30 |
| Methylene bis (dibutyl-dithiocarbamate) | 1.65 |
| Triethanolamine | 18.00 |
| Emulsifier (1) | 10.00 |
| Neodecanoic acid | 0.40 |
| Water | 68.65 |

| | |
|---|---|
| Disodium-2,5-dimercapto-1,3,4-thiadiazole (2) | 2.03 |
| Sulfurized lard oil (14–16% sulfur) | 2.26 |
| Olefin sulfide (36–39% sulfur) | 0.87 |
| Triethanolamine | 12.00 |
| Emulsifier (1) | 6.67 |
| Neodecanoic acid | 0.27 |
| Water | 74.90 |

| | |
|---|---|
| Disodium-2,5-dimercapto-1,3,4-thiadiazole (2) | 2.03 |
| Sulfurized lard oil (14–16% sulfur) | 2.26 |
| Methylene bis (dibutyl-dithiocarbamate) | 1.10 |
| Triethanolamine | 12.00 |
| Emulsifier (1) | 6.67 |
| Neodecanoic acid | 0.27 |
| Water | 75.67 |

| | |
|---|---|
| Disodium-2,5-dimercapto-1,3,4-thiadiazole (2) | 2.03 |
| Olefin sulfide (36–39% sulfur) | 0.87 |
| Methylene bis (dibutyl-dithiocarbamate) | 1.10 |
| Triethanolamine | 12.00 |
| Emulsifier (1) | 6.67 |
| Neodecanoic acid | 0.27 |
| Water | 77.06 |

| | |
|---|---|
| Sulfurized lard oil (14–16% sulfur) | 2.26 |
| Olefin sulfide | 0.87 |
| Methylene bis (dibutyl-dithiocarbamate) | 1.10 |
| Triethanolamine | 18.00 |
| Emulsifier (1) | 10.00 |
| Neodecanoic acid | 0.40 |
| Water | 67.37 |

| | |
|---|---|
| Disodium-2,5-dimercapto-1,3,4-thiadiazole (2) | 1.53 |
| Sulfurized lard oil (14–16% sulfur) | 1.70 |
| Olefin sulfide (36–39% sulfur) | 0.65 |
| Methylene bis (dibutyl-dithiocarbamate) | 0.83 |
| Triethanolamine | 13.50 |
| Emulsifier (1) | 7.50 |
| Neodecanoic acid | 0.30 |

-continued

| | |
|---|---|
| Water | 73.99 |

| | |
|---|---|
| Methylene bis (dibutyl dithiocarbamate) | 1.10 |
| Sulfurized lard oil (14–16% sulfur) | 2.26 |
| Olefin sulfide (36–39% sulfur) | 0.87 |
| Triethanolamine | 18.00 |
| Emulsifier (1) | 10.00 |
| 2,2' Dimethyl octanoic acid | 0.40 |
| Water | 67.37 |

| | |
|---|---|
| Methylene bis(dibutyl-dithiocarbamate | 1.10 |
| Sulfurized lard oil (14–16% sulfur) | 2.26 |
| Sulfurized olefin (33% sulfur) | 1.01 |
| Triethanolamine | 18.00 |
| Emulsifier (1) | 10.00 |
| 2,2' Dimethyl octanoic acid | 0.40 |
| Water | 67.23 |

| | |
|---|---|
| Methylene bis (dibutyl-dithiocarbamate) | 1.10 |
| Sulfurized lard oil (14–16% sulfur) | 2.26 |
| Ditertiary nonyl poly-sulfide (40% sulfur) | 0.83 |
| Triethanolamine | 18.00 |
| Emulsifier (1) | 10.00 |
| 2,2' Dimethyl octanoic acid | 0.40 |
| Water | 67.41 |

| | |
|---|---|
| Methylene bis (dibutyl-dithiocarbamate | 1.10 |
| Sul-Perm 110 (3) | 3.50 |
| Olefin sulfide (36–39( sulfur) | 0.87 |
| Triethanolamine | 18.00 |
| Emulsifier (1) | 10.00 |
| 2,2'Dimethyl octanoic acid | 0.40 |
| Water | 66.13 |

| | |
|---|---|
| Methylene bis (dibutyl-dithiocarbamate) | 1.10 |
| Sul-Perm 110 (3) | 3.50 |
| Sulfurized olefin (33% sulfur) | 1.01 |
| Triethanolamine | 18.00 |
| Emulsifier (1) | 10.00 |
| 2,2' Dimethyl octanoic acid | 0.40 |
| Water | 65.99 |

| | |
|---|---|
| Methylene bis (dibutyl-dithiocarbamate) | 1.10 |
| Sul-Perm 110 (3) | 3.50 |
| Ditertiary nonyl | 0.83 |

-continued

| | |
|---|---|
| polysulfide (40% sulfur) | |
| Triethanolamine | 18.00 |
| Emulsifier (1) | 10.00 |
| 2,2' Dimethyl octanoic acid | 0.40 |
| Water | 66.17 |

| | |
|---|---|
| Methylene bis (dibutyl-dithiocarbamate) | 1.10 |
| Sulfurized Rapeseed oil (10% sulfur) | 3.30 |
| Olefin sulfide (36–39% sulfur) | 0.87 |
| Triethanolamine | 18.00 |
| Emulsifier (1) | 10.00 |
| 2,2' Dimethyl octanoic acid | 0.40 |
| Water | 66.33 |

| | |
|---|---|
| Methylene bis (dibutyl-dithiocarbamate) | 1.10 |
| Sulfurized Rapeseed oil (10% sulfur) | 3.30 |
| Sulfurized olefin (33% sulfur) | 1.01 |
| Triethanolamine | 18.00 |
| Emulsifier (1) | 10.00 |
| 2,2' Dimethyl octanoic acid | 0.40 |
| Water | 66.19 |

| | |
|---|---|
| Methylene bis (dibutyl-dithiocarbamate) | 1.10 |
| Sulfurized Rapeseed oil (10% sulfur) | 3.30 |
| Ditertiary nonyl poly-sulfide (40% sulfur) | 0.83 |
| Triethanolamine | 18.00 |
| Emulsifier (1) | 10.00 |
| 2,2' Dimethyl octanoic acid | 0.40 |
| Water | 66.37 |

| | |
|---|---|
| Methylene bis (dibutyl-dithiocarbamate) | 1.10 |
| Sulfurized oleic acid (13% sulfur) | 2.56 |
| Olefin sulfide (36–39% sulfur) | 0.87 |
| Triethanolamine | 18.00 |
| Emulsifier (1) | 10.00 |
| 2,2' Dimethyl octanoic acid | 0.40 |
| Water | 67.07 |

| | |
|---|---|
| Methylene bis (dibutyl-dithiocarbamate | 1.10 |
| Sulfurized polyethylene glycol 400 dioleate (7.9% sulfur) | 4.23 |
| Olefin sulfide (36–39% sulfur) | 0.87 |
| Triethanolamine | 18.00 |
| Emulsifier (1) | 10.00 |
| 2,2' Dimethyl octanoic acid | 0.40 |
| Water | 65.40 |

-continued

| | |
|---|---|
| Methylene bis (dibutyl-dithiocarbamate) | 1.10 |
| Sulfurized oleic acid (13% sulfur) | 2.56 |
| Sulfurized olefin (33% sulfur) | 0.83 |
| Triethanolamine | 18.00 |
| Emulsifier (1) | 10.00 |
| 2,2' Dimethyl octanoic acid | 0.40 |
| Water | 67.11 |

(1) Nonylphenol ethoxylated with 9.5 moles of ethylene oxide
(2) 30% disodium-2,5-dimercapto-1,3,4-thiadiazole in water
(3) A sulfurized complex mixture of esters of animal and vegetable fats having 10% sulfur available from the Keil Chemical Division of the Ferro Corp. Sul-Perm is a registered trademark of the Keil Chemical Division of the Ferro. Corp.

Example 1 to 14 and 16 are comparative formulations and Examples 15 and 17 to 28 are formulations in accordance with this invention. The sulfur content in Examples 1 to 28 was kept constant. The triethanolamine, emulsifier and neodecanoic acid amounts were adjusted to produce stable emulsions.

The formulations of Examples 1 to 28 were evaluated in the following metal cutting test procedure and the results obtained shown in the table below.

Test Procedure

A wedge-shaped high speed tool is forced against the end of a rotating (95 surface feet per minute) SAE 1026 steel tube of one fourth of an inch thickness. The feed force of the tool is sufficient to cut a V-groove in the tubing wall, and the chips flow out of the cutting area in two pieces (one piece from each face of the wedge-shaped tool). The forces on the tool as a result of workpiece rotation and of tool feed were measured by a tool post dynamometer connected to a Gould recorder. Any welding of chips to tool build-up is reflected in the interruption of chip flow (visual) and in increased resistance to workpiece rotation. The cutting test is performed with the tool-chip interface flooded throughout the operation with 3000 grams of circulating test fluid. Tool and workpiece are in constant dynamic contact during this time, and the test is not begun until full contact is achieved all along each cutting edge. The duration of the test is three minutes.

The results obtained in accordance with the above test procedure using the formulations as shown in the above examples as the test fluid are given in the following table.

| Example No. | Formulation of Example No. | Force (lbs) |
|---|---|---|
| 29 | 1 | 475 |
| 30 | 2 | 488 |
| 31 | 3 | 415 |
| 32 | 4 | 428 |
| 33 | 5 | 448 |
| 34 | 6 | 428 |
| 35 | 7 | 435 |
| 36 | 8 | 448 |
| 37 | 9 | 428 |
| 38 | 10 | 456 |
| 39 | 11 | 455 |
| 40 | 12 | 468 |
| 41 | 13 | 445 |
| 42 | 14 | 444 |

-continued

| Example No. | Formulation of Example No. | Force (lbs) |
|---|---|---|
| 43 | 15 | 391 |
| 44 | 16 | 414 |
| 45 | 17 | 391 |
| 46 | 18 | 400 |
| 47 | 19 | 397 |
| 48 | 20 | 386 |
| 49 | 21 | 379 |
| 50 | 22 | 392 |
| 51 | 23 | 389 |
| 52 | 24 | 405 |
| 53 | 25 | 398 |
| 54 | 26 | 366 |
| 55 | 27 | 366 |
| 56 | 28 | 375 |

What is claimed is:

1. An aqueous machining fluid composition comprising a) water, b) a sulfurized organic material selected from the group consisting of sulfurized unsaturated aliphatic carboxylic acids having from 6 to 22 carbon atoms and salts thereof, sulfurized unsaturated esters of aliphatic carboxylic acids having from 1 to 22 carbon atoms, sulfurized polymerized unsaturated fatty acids and salts and esters thereof, and mixtures thereof, c) a sulfurized hydrocarbon and d) an aliphatic ester of a dialkyldithiocarbamic acid.

2. An aqueous machining fluid composition according to claim 1 wherein said ester of a dialkyldithiocarbamic acid has the following formula

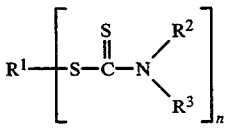

where $R^1$ is an aliphatic group having 1 to 20 carbon atoms and a free valence equal to n and $R^2$ and $R^3$ are individually alkyl groups having from 1 to 20 carbon atoms and n is an integer of 1 or 2.

3. An aqueous machining fluid composition according to claim 2 where $R^1$ is an alkylene group having from 1 to 20 carbon atoms and n is 2.

4. An aqueous machining fluid composition according to claim 2 where $R^1$ is an alkyl group having from 1 to 20 carbon atoms and n is 1.

5. The aqueous machining fluid composition of claim 2 wherein $R^1$ is alkyl having from 1 to 10 carbon atoms, $R^2$ and $R^3$ are individually alkyl groups having from 1 to 10 carbon atoms and n is 1.

6. The aqueous machining fluid composition according to claim 2 wherein $R^1$ is an alkylene group having from 1 to 10 carbon atoms, $R^2$ and $R^3$ are individually alkyl groups having from 1 to 10 carbon atoms and n is 2.

7. An aqueous machining fluid composition according to claim 2 wherein the sulfurized organic material is a sulfurized ester of an unsaturated aliphatic carboxylic acid having from 6 to 22 carbon atoms.

8. The aqueous machining fluid composition of claim 5 wherein the sulfurized organic material is sulfurized triglyceride.

9. The aqueous machining fluid composition according to claim 5 wherein the sulfurized organic material is a sulfurized triglyceride and the sulfurized hydrocarbon is an olefin sulfide.

10. An aqueous machining fluid composition according to claim 5 wherein said composition is an aqueous metalworking fluid composition.

11. An aqueous machining fluid composition according to claim 6 wherein the sulfurized organic material is a sulfurized triglyceride.

12. An aqueous machining fluid composition according to claim 6 wherein the sulfurized hydrocarbon is an olefin sulfide.

13. An aqueous machining fluid composition according to claim 6 wherein the sulfurized organic material is a sulfurized unsaturated ester of an aliphatic carboxylic acid having 1 to 22 carbon atoms.

14. The aqueous machining fluid composition according to claim 6 wherein the sulfurized organic material is a sulfurized triglyceride and the sulfurized hydrocarbon is an olefin sulfide.

15. The aqueous machining fluid composition according to claim 13 wherein the sulfurized hydrocarbon is a sulfurized olefin.

16. The aqueous machining fluid composition according to claim 14 wherein the alkylene group is a methylene group.

17. The aqueous machining fluid composition according to claim 15 wherein the alkylene group is a methylene group.

18. The aqueous machining fluid composition according to claim 14 wherein said fluid is an aqueous metalworking fluid composition.

19. An aqueous machining fluid composition according to claim 14 wherein the aliphatic ester of a dialkyldithiocarbamic acid is methylene bis(dibutyldithiocarbamate).

20. An aqueous machining fluid composition according to claim 6 wherein said fluid is an aqueous metalworking fluid composition.

21. An aqueous machining fluid composition according to claim 2 wherein said fluid is a concentrate.

22. An aqueous machining fluid composition according to claim 2 wherein the sulfurized organic material is a sulfurized unsaturated aliphatic carboxylic acid having from 6 to 22 carbon atoms or salt thereof.

23. An aqueous machining fluid composition according to claim 2 wherein the sulfurized organic material is a sulfurized polymerized unsaturated fatty acid or ester or salt thereof.

24. An aqueous machining fluid composition according to claim 6 wherein the sulfurized organic material is a sulfurized unsaturated aliphatic carboxylic acid having from 6 to 22 carbon atoms or salt thereof, the sulfurized hydrocarbon is a sulfurized olefin and the ester of the dialkyldithiocarbamic acid is methylene bis (dibutyldithiocarbamate).

25. An aqueous machining fluid composition according to claim 6 wherein the sulfurized organic material is a sulfurized polymerized unsaturated fatty acid or ester or salt thereof, the sulfurized hydrocarbon is a sulfurized olefin and the ester of the dialkyldithiocarbamic acid is methylene bis (dibutyldithiocarbamate).

26. The aqueous machining fluid composition according to claim 24 wherein the sulfurized organic material is sulfurized oleic acid or a salt thereof.

27. The aqueous machining fluid composition according to claim 25 wherein the sulfurized organic material is a sulfurized polymerized linoleic acid or ester or salt thereof.

* * * * *